United States Patent [19]

Crosslen

[11] 4,387,810

[45] Jun. 14, 1983

[54] SHINGLED RACK DISPLAY DEVICE

[75] Inventor: Louis J. Crosslen, Grafton, Wis.

[73] Assignee: Frank Mayer & Associates, Inc., Grafton, Wis.

[21] Appl. No.: 201,121

[22] Filed: Oct. 27, 1980

[51] Int. Cl.[3] ..... A47F 3/00

[52] U.S. Cl. ..... 211/49 D; 211/128; 211/81; 312/42

[58] Field of Search ..... 211/99, 49 D, 55, 128, 211/133, 168, 170, 81, 150, 47; 248/286, 242; 312/42, 72, 248, 251

[56] References Cited

U.S. PATENT DOCUMENTS

| | | | |
|---|---|---|---|
| 2,412,011 | 12/1946 | Sanderson | 211/99 |
| 2,666,530 | 1/1954 | Beren | 211/99 |
| 2,905,330 | 9/1959 | Lilja | 211/49 D |
| 2,943,742 | 7/1960 | Colley | 211/49 D |
| 3,019,907 | 2/1962 | Belejack | 211/49 D |
| 3,352,614 | 11/1967 | Andersen | 312/42 |
| 3,795,379 | 3/1974 | Gray | 248/242 |
| 4,037,756 | 7/1977 | Jaquish | 312/42 X |

FOREIGN PATENT DOCUMENTS

| | | | |
|---|---|---|---|
| 1104110 | 11/1955 | France | 312/42 |
| 1157389 | 5/1958 | France | 312/42 |

*Primary Examiner*—Ramon S. Britts
*Assistant Examiner*—Robert W. Gibson, Jr.
*Attorney, Agent, or Firm*—James E. Nilles

[57] ABSTRACT

A point of purchase display assembly comprising a pair of generally vertical support walls spaced laterally apart from one another, a plurality of generally rectangular merchandise supporting racks arranged to hang downwardly from said walls and in shingled relationship with one another. Each of the racks has an upper end, means pivotally mounting the upper end to and between the support walls for permitting swinging of the racks between a lower display and an upper generally horizontal loading position for racks located beneath the generally horizontally disposed racks, and other means on the walls and engageable by the rack to hold the latter in the upper position.

3 Claims, 7 Drawing Figures

SHINGLED RACK DISPLAY DEVICE

BACKGROUND OF THE INVENTION

The present invention relates to permanent point of purchase display assemblies, and particularly to such devices which are used for merchandising cigarettes in retail sales establishments. Current merchandising units have several disadvantages that limit their conduciveness to planned and impulse sales. Important features of any such assemblies are compactness, capacity, accessibility of merchandise contained therein to customers, and aesthetic appeal. For example, some merchandisers have racks with vertical dividers thereon for dividing the racks into vertical rows, each of the rows containing one brand of cigarette, stacked with the front panels of the adjacent packs abutting each other. The packs are singly removable by the customers at the columns' lower ends, and the capacity of such merchandisers are only limited by the height of the columns. However, the proliferation of cigarette brands has made such an arrangement a very inefficient user of space, as each of the brands are horizontally adjacent one another and the rack extends a relatively great linear distance along a shelf or floor and thereby prevent a simultaneous viewing of all available brands. Other merchandising racks include a four-sided, vertical, free-standing floor unit, the four sides being attached to each other along their lengths and at ninety degree angles to create a square plan view. The sides may be rotatable about a center support post or fixedly mounted on such a post, and the customer may view the four sides of these two types of rack by rotating the rack or by moving around it, respectively. As in the previously discussed prior art merchandiser, such a unit does not permit facile viewing of all available brands when each of those brands is placed on one of the four sides. If the cigarettes on such a merchandiser are arranged so that all brands are placed on and visible at each of the four sides when the rack is full, a customer may assume that his preferred brand is not in stock at any of the four sides if the side he first views does not have that brand. If the cigarettes on such a merchandiser are placed so that each brand is available on only one of the four sides, then a customer will have to check between one and four sides of the rack before finding his brand. Either method of arrangement causes customer irritation and delay, neither of which is conducive to cigarette sales.

SUMMARY OF THE INVENTION

The invention is a point of purchase merchandise display assembly comprising a pair of generally vertical support walls spaced laterally apart from one another, and a plurality of generally rectangular merchandise supporting racks, each having an upper end and arranged to hang downwardly from the walls and in shingled relationship with one another. Means pivotally mount the upper end to and between the support walls for permitting swinging of the racks between a lower display position and an upper generally horizontal loading position for racks located beneath the generally horizontally disposed racks. Other means are supported by the walls which are engageable by the rack to hold the latter in the upper position.

The racks are one piece, of generally rectangular configuration, and molded of plastic. Each of the racks is provided with an open side for access to and loading of merchandise, a closed side opposite the open side, and two opposite side walls joining the open and closed sides. A plurality of vertically disposed dividers parallel to and between the opposite side walls and integrally molded with the closed side may form vertical compartments between adjacent pairs of the dividers, ensuring and permitting vertical stacking of merchandise therein. Means are provided at the lower end of the racks to cause the merchandise to be moved outwardly a small extent at the lower end of the racks, facilitating grasping and removal of merchandise therein. Each of the racks has a plurality of retaining means adjacent the lower ends thereof and abutting the vertically stacked merchandise above the outwardly moved item of that merchandise. The pivotal mounting means may include pin and bracket means between the racks and walls to pivotably mount the racks on the walls and thereby permit the racks to swing. The bracket means have a generally T-shaped slot which is open intermediate its length to permit removal of the racks from the pin means, and when the racks are swung to their upper position, the pin means will be located in one end of the T-shaped slot. The other means for holding the rack in the upper position may include a horizontally disposed rod means fixedly mounted to the assembly between the support walls and positioned to abuttingly engage the opposite side walls and the open side of a rack in the upper position.

The rack is shiftable from its upper position to its lower display position wherein the pin means are located in the opposite end of the T-shaped slot and wherein the racks hang downwardly from the walls and in the shingled relation.

The assembly may also have a plurality of apertures in its closed side and between the dividers, for receiving a removable and vertically disposed tongue means therethrough. The tongue means are typically centrally positioned between adjacent dividers to thereby divide the vertical compartment in two.

The invention has several advantages over the prior art. It combines in one unit compactness, capacity, accessibility of merchandise, and aesthetic appeal. The shingled construction ensures a large capacity unit that occupies a small volume and a small area. The merchandise displayed in the assembly, such as cigarettes, may be stacked to a height limited only by the height of the rack itself, permitting the rack to hold a large quantity of merchandise and thereby increasing the intervals between its emptying. Regardless of the height of each rack, the shingled or nested relationship of the racks permits a customer to see many brands of cigarettes at once and without moving, thereby encouraging sales. The customer can see all of the displayed brands at once because they are in close proximity, and for this reason he may also readily reach each of those brands. Other objects and advantages of this invention will appear hereinafter.

DESCRIPTION OF A PREFERRED EMBODIMENT

Figure 1:
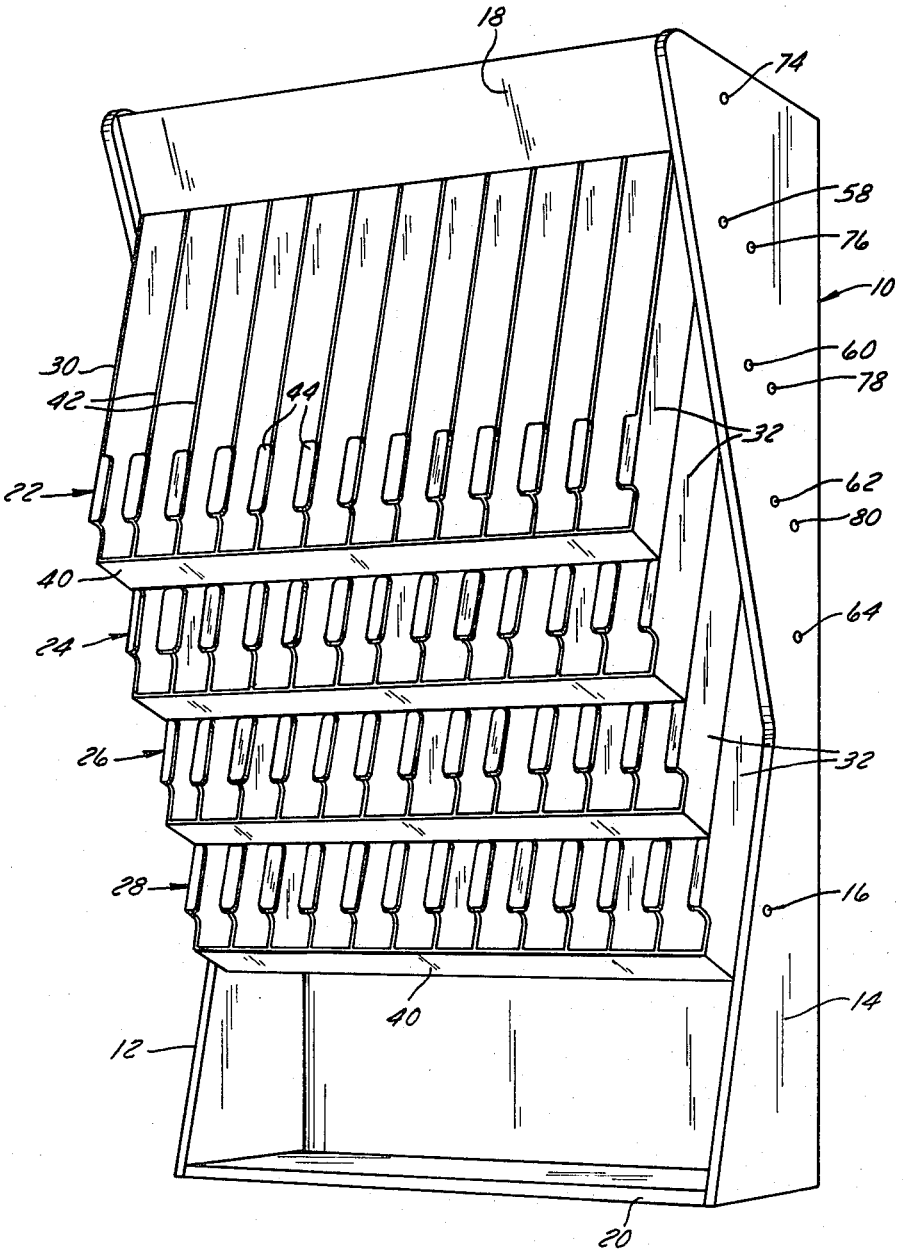
FIG. 1 is a perspective view of a display assembly comprising a preferred embodiment of the invention.
Figure 3:
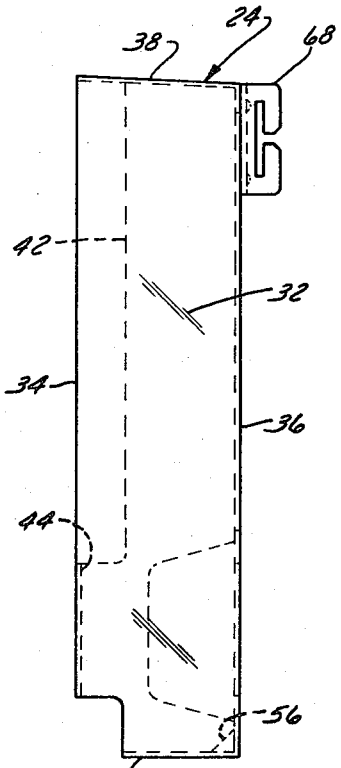
FIG. 3 is a side elevational view of the rack of FIG. 2, the view being taken from line 3—3 in FIG. 2.
Figure 4:
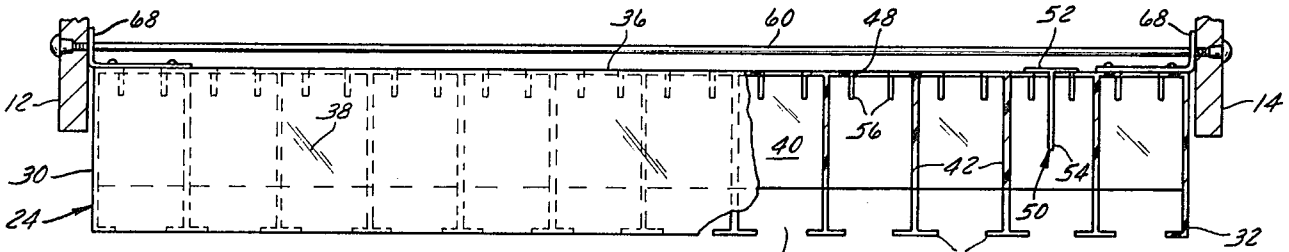
FIG. 4 is a plan view of the rack of FIG. 2, and partially broken away and in section for clarity.
Figure 2:
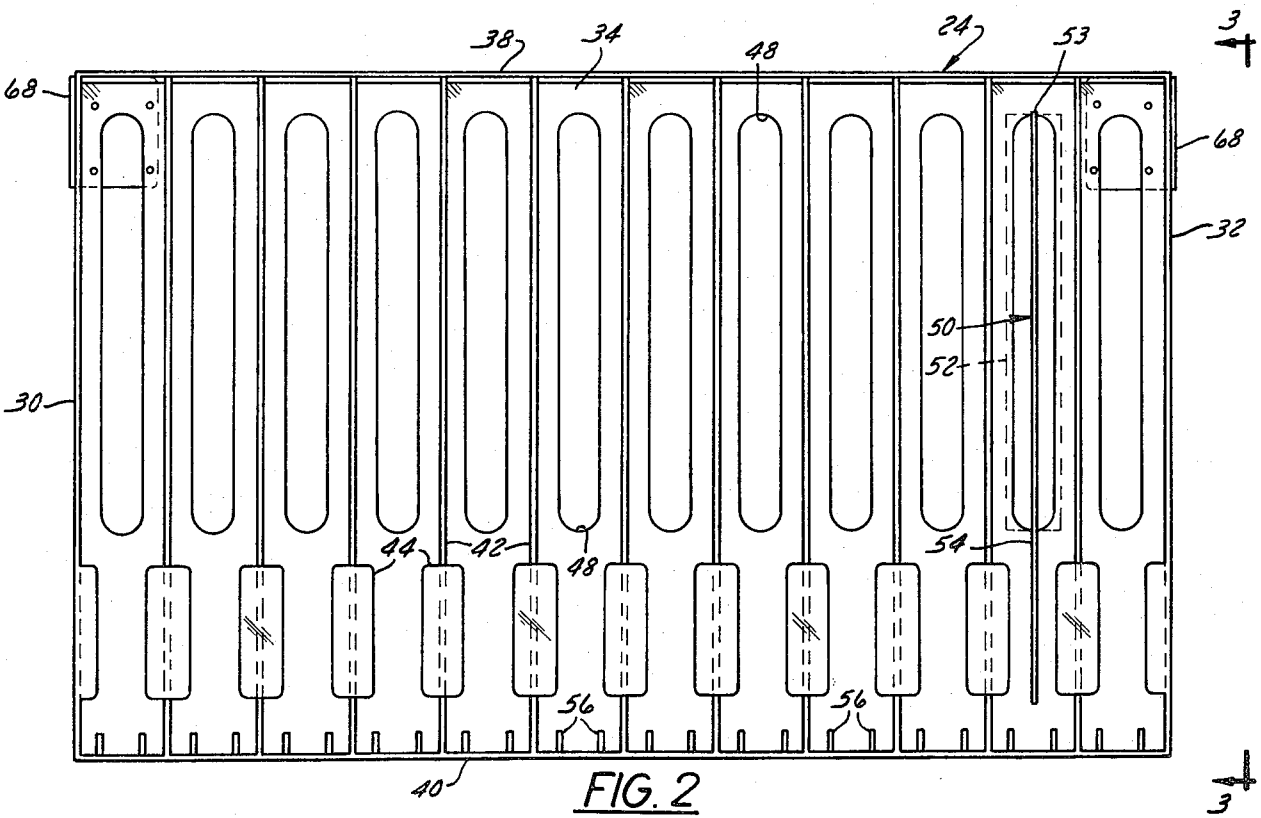
FIG. 2 is a front elevational view of one of the merchandise supporting racks shown in FIG. 1 and showing a vertically disposed tongue means in a vertical compartment.

The point of purchase merchandise display assembly described herein may include a unit with as few as two racks, each having a shingled relationship to the other, as for example in a unit constructed to be placed adjacent a wall or suspended from a ceiling. Alternatively, the assembly may be intended for free-standing or counter-mounted use, and its accessibility from either of two sides enables racks to be mounted so that their open ends face oppositely from each other. This embodiment will describe a free-standing unit suitable for placement against a wall and having four racks in shingled relation as shown in FIG. 1.

The point of purchase merchandise display assembly 10 is substantially supported by a pair of generally vertical support walls 12 and 14 spaced laterally apart from one another. In a floor-standing unit, as shown in FIG. 1, these walls 12 and 14 may extend downwardly to provide support of the rack. In a wall-mounted unit, such extensions are unnecessary and the vertical support walls need not extend downwardly of the lower rack. Suitable cross members 18 and 20 may be placed at the top and bottom of the rack, respectively, to increase the rigidity and strength of the assembly, the top member 18 also providing a front-facing flat surface for placement of price information on the manufacturer's advertising or logo thereon.

MERCHANDISING SUPPORTING RACKS

Means are provided for holding merchandise within the assembly and in a ready-for-sale position. The display assembly has four merchandise supporting racks, 22, 24, 26 and 28 (FIG. 3), although other numbers of racks may be employed in accordance with the present invention. Rack 24 is shown in FIGS. 2–6, and as the racks are similar to one another, only one will be described in detail. The rack is preferably fabricated of a rigid, impact-resistant material, such as by plastic injection molding to give a unit suitable for the shape of the merchandise to be container therein. Rectangular-shaped racks are preferable for box-like units of merchandise, such as cigarette packs. The rack's rectangular shape is defined by two opposite, vertical side walls 30 and 32, and open side 34 for access to and loading of the merchandise, and a closed side 36 opposite to the open side, the side walls 30 and 32 joining the closed and open sides. Spaced-apart upper 38 and lower end 40 join and are perpendicular to side walls 30 and 32. The closed side may be apertured for auxiliary purposes as will be explained hereinbelow, but the apertures must be sufficiently small to prevent removal of merchandise from the rack through that side.

When it is desired to stack the merchandise in the rack in vertical relationship, side support means are required, and comprise a plurality of vertically disposed dividers 42 parallel to and between the opposite side walls and integrally molded therewith. Adjacent dividers 42, together with open 34 and closed sides 36, cooperatively form vertical compartments of dimensions slightly larger than the length and width of cigarette packs so that they may be stacked on their broadest front- and rear-facing panels as shown in racks 22, 26, and 28 of FIG. 5.

Each divider 42 has a merchandise retaining means 44 integrally molded therewith at the front or open side 34 and adjacent the lower end 40 of the rack. The divider does not extend as far down as the lower end 40, ensuring that the cigarette pack abutting the lower end is not obstructed in any way by that divider (FIG. 5, rack 26) so as to ensure that pack's facile removal from the rack upon grasping and pulling the pack outwardly. As most customers will purchase one pack at any given time, the retaining means 44 permits removal of only one pack at a time. As that lowest pack is pulled outwardly, the one directly above it will also move outwardly because of inertia and friction between the adjacent packs until the upper pack strikes the retaining means 44 and is prevented from further outward movement. The retaining means are of a width sufficient to ensure that the packs positioned above the lowermost cannot be removed from the open side of the rack. The retaining means provided on the vertical side walls 30 and 32 need only be half the size of those attached to the dividers 42 (FIGS. 1, 2, 7), as each of the side walls defines part of only one vertical compartment.

Molding access holes 46 were provided in the closed wall (FIG. 7) portion of the die to facilitate the building of other portions of the die, particularly the dividers. Abutting and integrally molded to the closed side 36 and lower end 40 in each vertical compartment is a pair of triangular displacement means 56 to cause the cigarettte packs to be moved outwardly a small distance at the lower end and to thereby facilitate grasping the removal of the packs from the rack.

TONGUE MEANS FOR COMPARTMENT DIVISION

Figure 7:
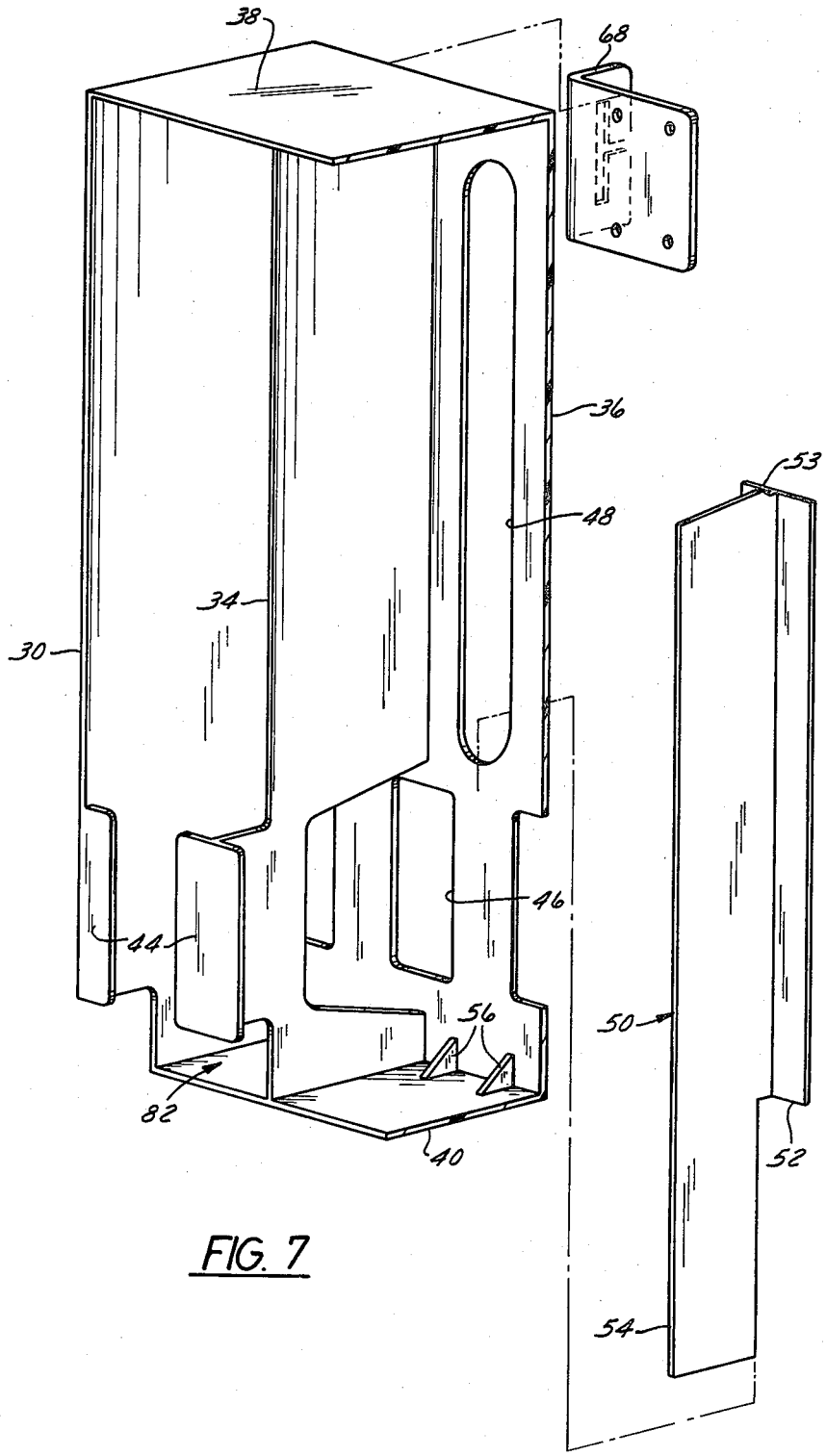
FIG. 7 is a fragmentary, perspective, exploded, view of the left portion of the rack shown in FIG. 2 but on an enlarged scale, and also showing the means for dividing a compartment.

Means are provided for dividing each vertical compartment into two narrower, vertical sub-compartments. For example, an oblong-shaped aperture 48 may be provided in the closed side 36 which is substantially centered between vertical compartment-defining pair of dividers 42. Removably engageable in the aperture 48 is a tongue means 50 comprising a base plate 52 and a tongue 54, the latter being slightly longer than and perpendicularly disposed to the former. The tongue means is insertable in each of the vertical compartments except those having a bracket attached to their closed sides, as shown in FIG. 7. The bottom of the tongue 54 is passed from the back of the closed side 36 and into the vertical compartment, and then pushed downwardly towards the lower end 40 and inwardly so that base plate 52 abuts the portion of closed side 36 surrounding aperture 48, and tongue 54 extends through a substantial portion of the vertical compartment but does not abut the lower end 40 (FIGS. 2, 4, 5 and 6). A tab 53 at the top of and integrally molded with tongue 54 aids in the retention of the tongue means 50 within the aperture 48.

Figures 5, 6:
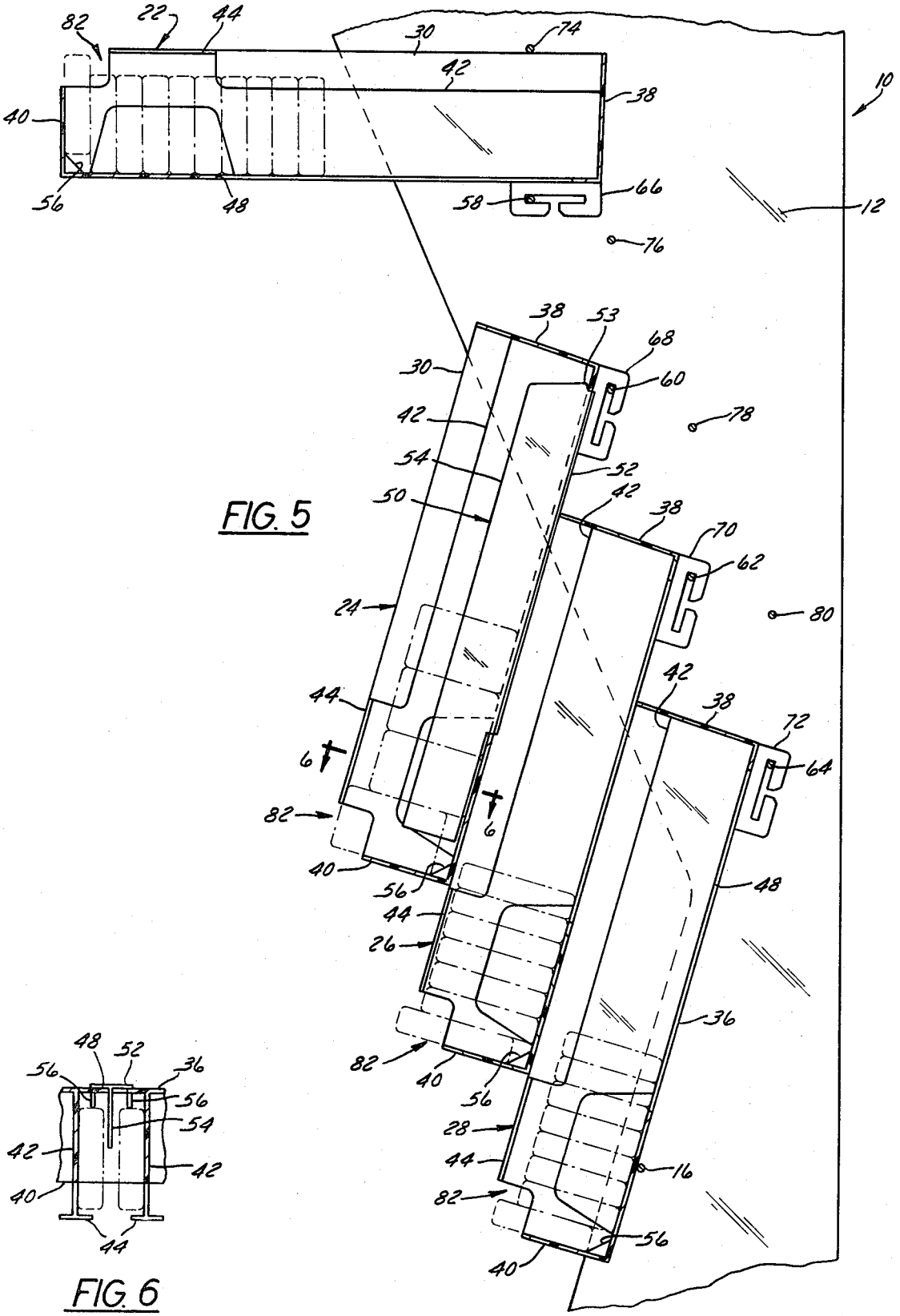
FIG. 5 is a fragmentary side elevation view of the display assembly of FIG. 1, but on an enlarged scale and with cigarette packages in place, showing the uppermost rack of the assembly raised to the horizontal position and with certain parts shown in section or broken away for clarity.
FIG. 6 is a sectional view of a portion of one of the racks of the display assembly shown in FIG. 5, the view being taken on the line 6—6 of FIG. 5.

By dividing the vertical compartment into two narrower vertical compartments (FIG. 2), the packs may be stacked with their side-panels abutting (FIG. 5, rack 24; FIG. 6). A retainer selling very many brands and having limited racks in which to sell them may wish to use tongue means to create two compartments where one existed before, creating space for two brands of cigarettes where room for one existed before. Slow-moving brands may be placed in such sub-compartments, freeing normal compartments for faster sellers. To remove end-panel stacked packs from their sub-compartments, the cigarette pack to be removed is grasped and moved towards the space between an adjacent pair of retaining means 44 so that the pack clears both retaining means, and is then pulled outwardly. Insertion of the tongue means creates two sub-compartments and the need for a displacement means 56 in each to ensure outward movement of the lowermost packs in each sub-compartment.

RACK SUPPORT AND PIVOT MEANS

Means are provided for supporting and swinging the racks on the assembly, and for maintaining a rack in a generally horizontal position to permit loading of the rack therebelow.

Pin and bracket means are provided between the racks and the walls to pivotally mount the racks on the walls and permit swinging of the racks. The pin means 58, 60, 62 and 64 are fixedly and non-rotatably mounted between vertical support walls 12 and 14, and support racks 22, 24, 26, and 28, respectively. Brackets 66, 68, 70 and 72 and rod means 74, 76, 78 and 80 are also provided for the same respective racks.

For example, rack 26 is shown in the normal, display position. The L-shaped brackets 70 have screws (not shown) through one of the legs thereof to attach that leg to the closed side. The other portion or leg of the L-shaped brackets have T-shaped slots therein which are open intermediate their lengths to permit removal of the rack 26 from the pin means 62 in the vent the former should break and require replacement. Rack 26 must be swung upwardly to permit loading of rack 28, and this upwardly-swung position is illustrated by rack 22 in FIG. 6. Pin means 58 is located in one end of the T-shaped slot when rack 22 is horizontal, and would be in the opposite end of the T-shaped slot when rack 22 is in the lowered display position, i.e., the positions of racks 24, 26, and 28 in FIG. 5. To move a rack 24 from the lowered, display position to the upper, horizontal loading position, the lower end 40 thereof is grasped and swung in a clockwise direction about the axis formed by pin means 60 in the opposite end of the T-shaped slot. When the tray 24 is in a substantially horizontal position, an inward push is imparted to the lower end 40 to urge the tray to guidably slide along pin means 60 until the pin means are located in the same end of the T-shaped slot as shown by rack 22 in FIG. 5. With rack 24 so positioned, rod means 76, which is also fixedly and non-rotatably mounted between vertical support walls 12 and 14, abuttingly engages the open end at side walls 30 and 32. As the bracket is slidably moved along the pin means, the weight of the rack prevents inadvertent removal thereof by preventing movement of the pin means through the opening intermediate the slot.

With the rack 22 in the horizontal, loading position, the portion of the vertical compartments of rack 24 above the upper end of the retaining means 44 is revealed, and cigarette packs may be easily placed into the compartments. When rack 24 has been reloaded and the rack 22 is replaced in the normal display position, the portion of the vertical compartments of rack 24 above the retaining means 44 is concealed again to effect an aesthetically pleasing configuration and to further permit facile access of cigarette packages in all of the compartments in racks 22 and 24.

Cigarette packs of various lengths may be accommodated in the display rack, as shown in FIG. 5. Short packages in rack 28 and longer packages in rack 26 are both pushed outwardly by their respective displacement means. The longer packages may readily be grasped by the purchaser, as they are pushed outwardly and beyond the retaining means 44 of rack 26 by displacement means 56. The short packages, however, do not normally extend beyond the retaining means of rack 28, and grasping thereof is facilitated by a quadrant section 82 cut out of the lower side walls 30 and 32 of each of the racks.

RESUME

The arrangement of the merchandise display assembly of the present invention provides a means for facilitating access to many different brands of cigarettes or other kinds of merchandise without the need for the purchaser to move from one location to another. The merchandise-holding racks are inexpensively constructed, sturdy, and easily replaced. A substantial amount of merchandise is accommodated in a relatively small area, as the storage capacity increases by upwardly extending the vertical compartments. As the adjacent racks are in a shingled or nested relationship, the capacity of the assembly can be increased without unduly great increases in compartment heights.

I claim:

1. A point of purchase merchandise display assembly comprising a pair of generally vertical support walls spaced laterally apart from one another, a plurality of generally rectangular one piece, molded plastic merchandise supporting racks arranged in shingled relationship with one another and each having an upper and lower end, each of said racks also having an open side for access to and loading of said merchandise, a closed side opposite to said open side, and two opposite side walls joining said open and closed sides and further having a plurality of vertically disposed dividers parallel to and between said opposite side walls and integrally molded with said closed side and to form a vertical compartment between adjacent dividers to insure vertical stacking of said merchandise therein, said closed side having a plurality of apertures therein, said apertures being generally between said dividers and for receiving a removable and vertically disposed tongue means therethrough, said tongue means centrally positioned between adjacent dividers to thereby divide said vertical compartment in two, and displacement means at said lower end of said racks to cause said merchandise to be moved outwardly a small extent at said lower end of said racks to facilitate grasping and removal of said merchandise from said racks, each of said racks having a plurality of retaining means adjacent said lower end and abutting said vertically stacked merchandise above said outwardly moved item of said merchandise, means pivotally mounting said upper end to and between said support walls for permitting swinging of said racks between a lower display position and an upper generally horizontal loading position for racks located beneath said generally horizontally disposed racks, said mounting means including pin and bracket means between said racks and said walls to pivotally mount said racks on said walls to permit said swinging thereof, said pin and bracket means including a pin and further including a bracket with a generally T-shaped slot with two opposite ends along its length and which is open intermediate its length to permit removal of said racks from said pin, said racks being swingable to said upper position wherein said pin is located in one of said ends of said T-shaped slots and other means on said walls and engageable by said rack to hold the latter in said upper position, said rack being shiftable to a display position wherein said pin means are located in an opposite end of said T-shaped slot to permit said racks to hang downwardly from said walls and in said shingled relation.

2. The assembly set forth in claim 1, wherein said other means for holding said rack in said upper position comprises a horizontally disposed rod means fixedly mounted to said assembly between said support walls and positioned to abuttingly engage said opposite side walls and said open side when said rack is in said upper position.

3. A point of purchase merchandise display assembly comprising a pair of generally vertical support walls spaced laterally apart from one another, a plurality of generally rectangular one piece, molded plastic merchandise supporting racks arranged in shingled relationship with one another and each having an upper and lower end, each of said racks also having an open side for access to and loading of said merchandise, a closed side opposite to said open side, and two opposite side walls joining said open and closed sides and further having a plurality of vertically disposed dividers parallel to and between said opposite side walls and integrally molded with said closed side and to form a vertical compartment between adjacent dividers to insure vertical stacking of said merchandise therein, said closed side having a plurality of apertures therein, said apertures being generally between said dividers and for receiving a removable and vertically disposed tongue means therethrough, said tongue means centrally positioned between adjacent dividers to thereby divide said vertical compartment in two, and displacement means at said lower end of said racks to cause said merchandise to be moved outwardly a small extent at said lower end of said racks to facilitate grasping and removal of said merchandise from said racks, each of said racks having a plurality of retaining means adjacent said lower end and abutting said vertically stacked merchandise above said outwardly moved item of said merchandise, means pivotally mounting said upper end to and between said support walls for permitting swinging of said racks between a lower display position and an upper generally horizontal loading position for racks located beneath said generally horizontally disposed racks, said mounting means including pin and bracket means between said racks and said walls to pivotally mount said racks on said walls to permit said swinging thereof.

* * * * *